US005738557A

United States Patent [19]

Biesecker

[11] Patent Number: 5,738,557

[45] Date of Patent: Apr. 14, 1998

[54] POCKET-SIZED, EMERGENCY FLOTATION DEVICE

[76] Inventor: Bradley A. Biesecker, 1316 School St., Clarks Summit, Pa. 18411

[21] Appl. No.: 655,651

[22] Filed: May 30, 1996

[51] Int. Cl.[6] ..... B63C 9/15

[52] U.S. Cl. ..... 441/92; 441/118; 441/123

[58] Field of Search ..... 441/92–94, 102, 441/103, 106, 90, 108, 113, 117, 118

[56] References Cited

U.S. PATENT DOCUMENTS

| | | | |
|---|---|---|---|
| 731,314 | 6/1903 | Malmqvist | 441/113 |
| 2,223,880 | 12/1940 | Ardern | 441/113 |
| 2,774,979 | 12/1956 | Moran | 441/94 |
| 4,560,356 | 12/1985 | Burr | 441/94 |
| 4,887,987 | 12/1989 | Kato | 441/123 |
| 5,393,254 | 2/1995 | Ducheshe | 441/108 |
| 5,466,179 | 11/1995 | Jeffrey, Sr. | 441/108 |

FOREIGN PATENT DOCUMENTS

| | | | |
|---|---|---|---|
| 531962 | 1/1941 | United Kingdom | 441/93 |

*Primary Examiner*—Sherman Basinger
*Attorney, Agent, or Firm*—Salzman & Levy

[57] ABSTRACT

The present invention features a pocket-sized, portable, flotation device that folds into a carrying case, which is the size of a cellular phone or camera. It can be carried upon a person in a shirt pocket or clipped to a waistline belt. The flotation device inflates into a diamond-shaped collar. The diamond shape of the flotation collar is uniquely constructed, so as to provide sufficient buoyancy to keep the user's head afloat. The diamond shape is also useful in preventing deflation of the device; it uniquely separates the flotation balloon into four separate compartments or cells, each of which is substantially sealed from adjacent compartments to prevent or reduce deflation of the adjacent cells through puncture or other mishap to one of the cells. The unique sealing construction is operative by the simple means of an approximately sixty-degree construction angle at the apex seam between the lobes. The acute angle between the divided lobes of the balloon effectively seals from each other the individual compartments on each lobe of the collar. Thus, full deflation is prevented, should one of the compartments become punctured.

15 Claims, 4 Drawing Sheets

POCKET-SIZED, EMERGENCY FLOTATION DEVICE

FIELD OF THE INVENTION

The present invention pertains to emergency flotation equipment and, more particularly, to a flotation device that a person can easily carry in a stored position within a shirt pocket, or attach to a belt.

BACKGROUND OF THE INVENTION

The art of flotation equipment is filled with a myriad of devices for providing buoyancy to a wearer in emergency situations. Most of the designs involve rather large, bulky pieces of equipment that cannot easily be carried on a person. An exception to this, however, is the "Self Inflatable Flotation Device" presented in U.S. Pat. No. 5,466,179 (issued to JEFFREY, Sr., on Nov. 14, 1995). The flotation device of this invention is strapped about the waist of the user. The device itself is stored in a small pouch that opens to release an inflatable, doughnut-shaped balloon that has a single air cavity.

Despite its fold-up construction, the aforementioned flotation device is too large to be a true convenience to the wearer. The pouch-type construction can be carried on the person only about the waist via an attachment belt. Carrying the device about the waistline can be intrusive enough to some users to become bothersome, especially when sitting in narrow or confined areas, such as on an aircraft. Such a pouch must usually be detached during the partaking of meals and beverages, as when a food tray is lowered on an airplane. Moreover, a single air cavity is vulnerable to puncture, rendering the device useless.

U.S. Pat. No. 4,560,356 (issued to BURR on Dec. 24, 1985) describes a personal flotation device. The device is stored in a container which automatically opens when a release is pulled, allowing the inflation of the device that is worn around the waist of the user.

One of the major objectives of the present invention is to design a flotation device that is so small that it is no bigger than a cellular phone or a camera. The flotation pack is small enough that it can be carried unobtrusively about the person in a place convenient to individual tastes. For example, the device can be carried in a shirt or a jacket pocket, or clipped to the wearer's belt at any point about the girth. In other words, the flotation pack of the present invention is truly both portable and convenient.

Another objective of the current invention is to provide a flotation device that inflates into a diamond-shaped collar. The diamond shape of the flotation collar is uniquely constructed, so as to provide sufficient buoyancy to keep the user's head afloat. The diamond shape is also useful in preventing deflation of the device; it uniquely separates the flotation balloon into four separate compartments, each of which is substantially sealed from adjacent compartments to prevent a complete deflation through puncture or other mishap. This unique sealing construction is operative by the simple means of the approximately sixty-degree construction angle at the apex seam. The acute angle between the bifurcated lobes of the balloon effectively seals from each other the two compartments on each lobe of the collar. Thus, full deflation is prevented, should one of the bifurcated compartments become punctured.

One of the unique features of this diamond-shaped construction is that the sealing is effected without the need for check-valves between the chambers of the balloon. This simplified construction is inexpensive to manufacture.

Another unique characteristic of the diamond-shaped collar is that it provides a large measure of support for both the head and the neck. The unique, acutely-angled apex of the diamond fits snugly within the crook or nape of the neck, and helps keep the user's head afloat.

It is an object of this invention to provide an improved, portable, flotation device that can be carried about several parts of the body, in order to provide the maximum comfort to the user.

It is another object of the invention to provide a portable, flotation device that is approximately the size of a small camera.

It is a further object of this invention to provide a portable, flotation device that inflates into a diamond-shaped neck collar which is compartmentalized into a series of individual, inflated balloon compartments.

SUMMARY OF THE INVENTION

In accordance with the present invention, there is provided a small, portable, flotational device that folds into a carrying case, which is approximately the size of a small camera. It can be carried upon a person in a shirt pocket, or clipped, snapped, or otherwise attached to a waistline belt. The flotation device inflates into a diamond-shaped collar. The diamond shape of the flotation collar is uniquely constructed, so as to provide sufficient buoyancy to keep the user's head afloat. The diamond shape is also useful in preventing deflation of the device; it uniquely separates the flotation balloon into four separate compartments, each of which is substantially sealed from adjacent compartments to prevent a complete deflation through puncture or other mishap. The unique sealing construction is operative by the simple means of the approximately sixty-degree construction angle at the apex seam between the lobes. The acute angle between the bifurcated lobes of the balloon effectively seals from each other the individual compartments on each lobe of the collar. Thus, full deflation is prevented, should one of the bifurcated compartments become punctured.

BRIEF DESCRIPTION OF THE DRAWINGS

A complete understanding of the present invention may be obtained by reference to the accompanying drawings, when considered in conjunction with the subsequent, detailed description, in which.

DESCRIPTION OF THE PREFERRED EMBODIMENT

Generally speaking, the invention features an emergency flotation device that can be folded into a small pack that is easily carried almost anywhere on a person. The flotation device folds up like the pleats of an accordion, or is rolled and housed in a case that is the approximate size of a small camera.

Figure 1:
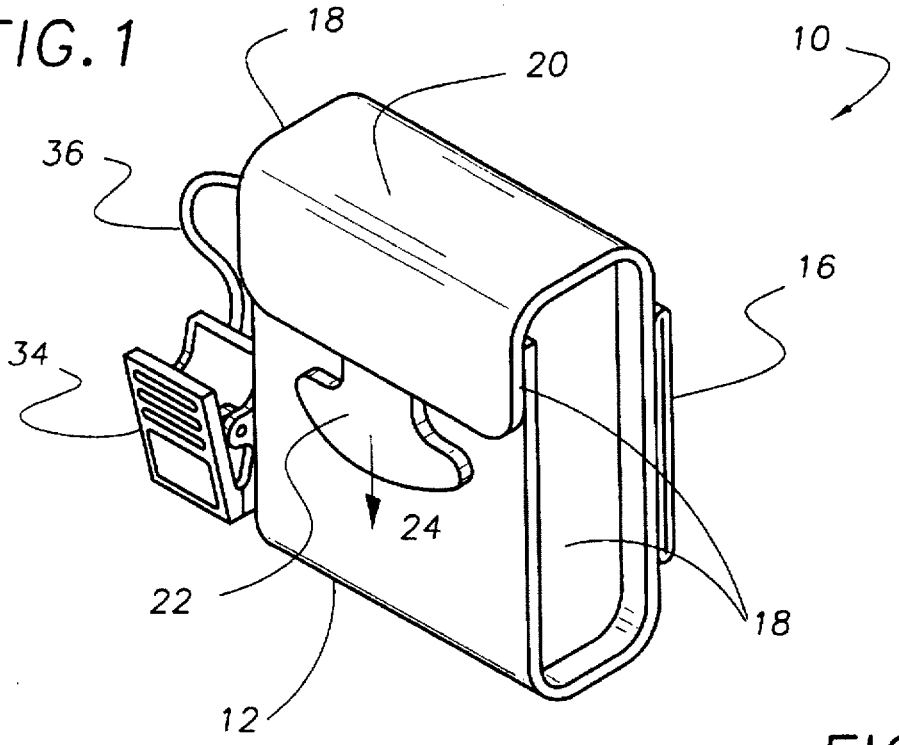
FIG. 1 illustrates a perspective view of a carrying case in which the flotation device of this invention is housed, with the case being in a closed position.
Figure 2:
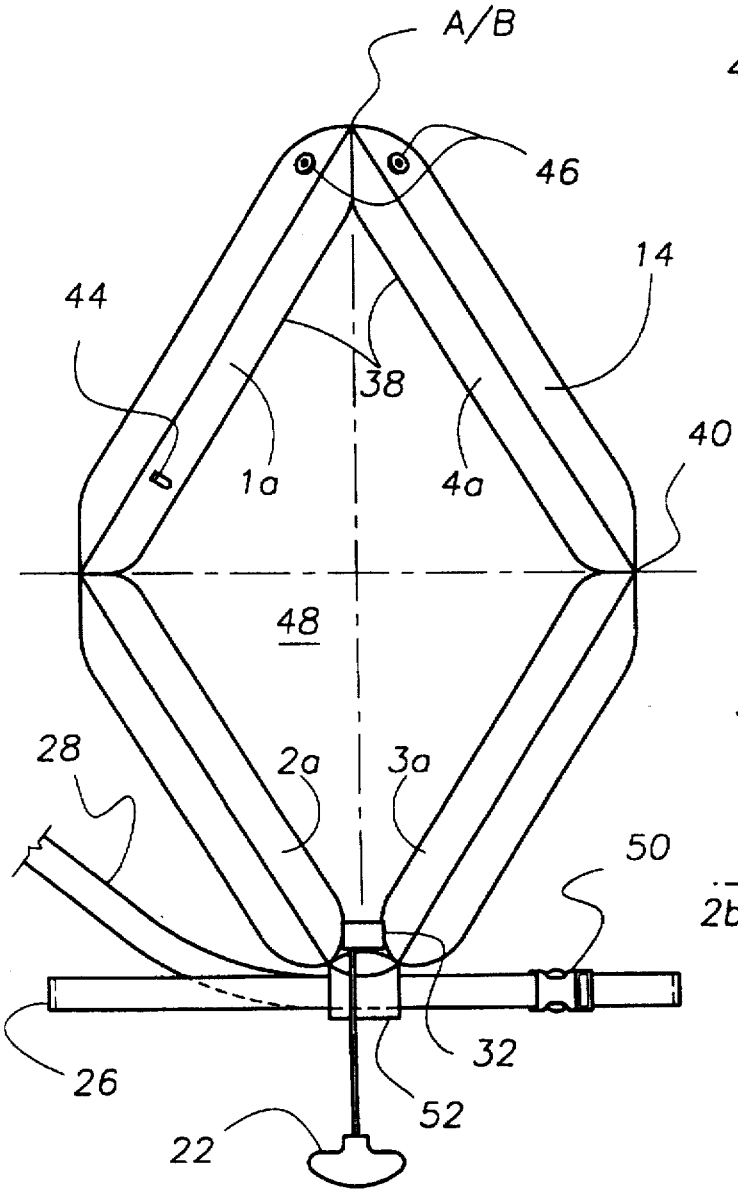
FIG. 2 shows an inflated, plan view of the flotation balloon collar of the inventive flotation device.

Now referring to FIG. 1, the flotation device 10 of the present invention includes a closed carrying case 12 is shown, which houses the expanded flotation collar 14 that is illustrated in the plan view of FIG. 2. The case 12 is very small, about the size of a small, portable camera (1.75"× 3.0"×6.5"). These small dimensions allow one to carry the case 12 almost anywhere upon one's person, e.g., in a shirt pocket, or hanging from a waistline belt by means of a strap 16.

The case 12 comprises a soft nylon body 18 formed of flexible, planar material that folds over to form a protective lid 20. Disposed beneath the lid 20, but not necessarily attached thereto, is a lanyard 22, which is pulled downwardly (arrow 24), once the lid 20 is opened, in order to actuate the inflation of the flotation collar 14 housed therein.

Figure 3:
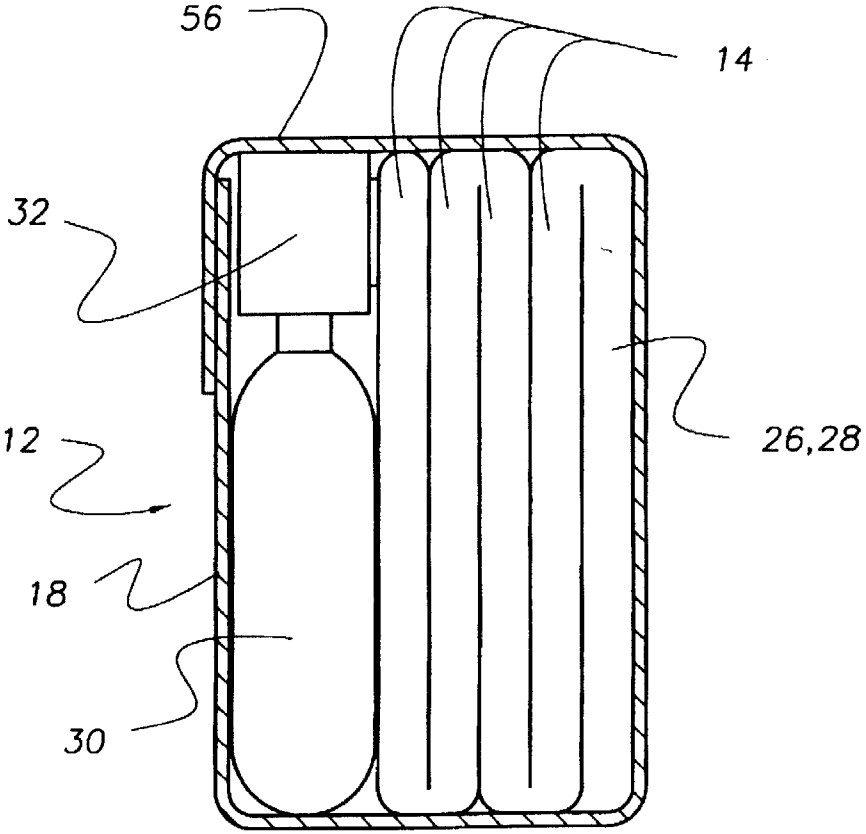
FIG. 3 shows a sectional view of the case illustrated in FIG. 1, with the flotation balloon collar folded and stored inside the case.

When in the deflated state, the flotation collar 14 folds (like the pleats of an accordion) or rolled, and is easily housed within the carrying case 12, as illustrated in FIG. 3. Attached to the flotation collar 14 are a band or belt 26 and a tether line 28, which is also folded into case 12. A $CO_2$ cartridge 30 and an inflation valve 32, are also disposed in case 12.

Figure 1A:
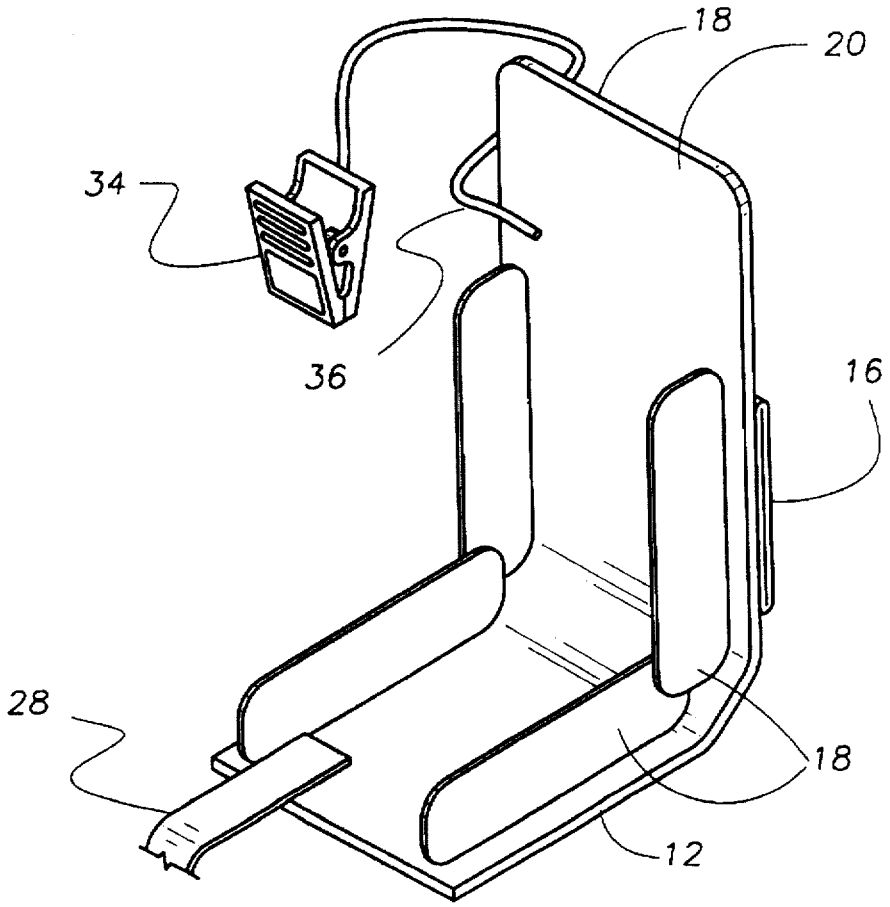
FIG. 1*a* depicts a perspective view of the carrying case shown in FIG. 1, with the case in an open position.

Along the side of the body 18, a security fastener 34 can be secured. The security fastener 34 is attached via cord 36 to the inside of the case body 18, as shown in greater detail in FIG. 1*a*. The security fastener 34 is nothing more than a spring-loaded clip for securing the case 12 to the user; it prevents the loss of the case 12. As aforementioned, once the case 12 is opened, the lanyard 22 can be pulled downwardly, as shown by arrow 24 in FIG. 1. The inflating collar 14 will assume the open position illustrated in FIG. 1*a*. The lanyard will cause the cartridge 30 (FIG. 3) to expel gas into the flotation collar 14 via inflator manifold (valve) 32.

Referring to FIG. 2, the flotation collar 14 is shown in its expanded, inflated state. The collar 14 has a soft (but tough), lightweight, urethane plastic-coated nylon skin that inflates with pressurization of the $CO_2$ cartridge 30. The cartridge is actuated by the pull of the lanyard 22, which in turn opens valve 32, and emits carbon dioxide into the hollow body of collar 14. The collar 14 assumes a diamond shape 38, and comprises four separate balloon chambers or cells 1*a*, 2*a*, 3*a* and 4*a*, respectively. These balloon chambers fill with gas and inflate to form the diamond structure 38, shown in the FIGURE.

Each cell is sealed with a perpendicular seam 40 to make a rectangular cell with a small air passage (orifice, aperture) 42 at the midpoint of the seam. This permits a continual flow of $CO_2$ to all cells. Full inflation causes a fold of approximately sixty degrees at the seam, forming a yoke which substantially seals the small air package. The main functions of the seams are to provide a check-valve between the two cells for safety, as well as a folded edge to make the four sections close easily (with an accordion-type fold) or is rolled for storing in the case 12. Any one of the four cells could be damaged and deflated, leaving the other three substantially inflated. An oral inflator 44 is affixed to one of the upper cells la, making it easy to inflate. The manual inflator manifold 32 is affixed between two cells at the bottom of the collar 14. It is aligned parallel to the cell seams, so that an even fold and a small overall package can be obtained. Size may vary for increased buoyancy. Two small gas release valves 46 are located near the seam A/B on cells la and 4*a*. This allows the complete removal of all $CO_2$, when packing.

As aforementioned, the band 26 allows for the waist attachment of the collar 14 around the user's torso, after one inserts one's head through the opening 48 of the diamond structure 38. The band 26 has a quick snap buckle fastener 50, which allows for the attachment, despite differently-sized girths.

Figure 2A:
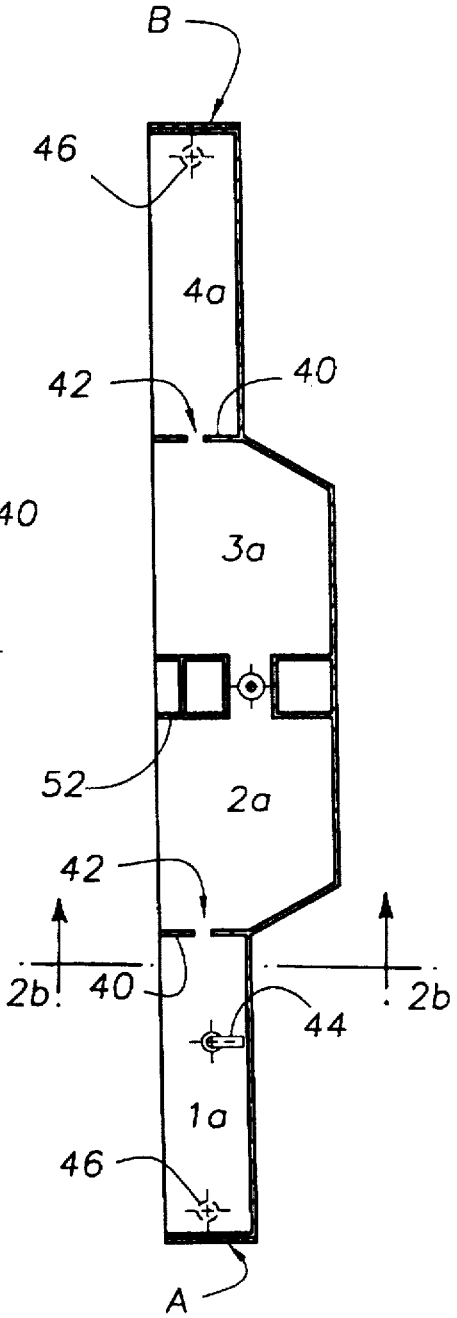
FIG. 2*a* illustrates an internal, flat layout development view of the flotation balloon depicted in FIG. 2.
Figure 2B:
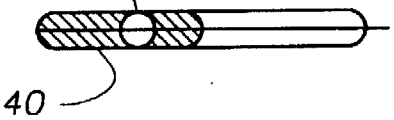
FIG. 2*b* depicts a sectional view of FIG. 2's flotation balloon, taken along lines A—A.

Referring to FIG. 2*a*, an internal, flat layout development view of collar 14 is shown, separated at seam A/B. The collar 14 is seam-welded at points A and B, shown connected in FIG. 2. The inflation gas from cartridge 30 expands into all of the respective chambers la, 2*a*, 3*a* and 4*a* via the orifices 42 disposed within the cross-sectional walls 40. (See also the sectional view shown in FIG. 2*b*.) When the collar expands 14 to form the diamond shape 38, these apertures 42 become substantially pinched off. This pinching prevents or reduces deflation of all of the chambers, in the event that any one chamber becomes punctured. It has been determined that the acute 60-degree (120°) angle between the adjacent chambers is sufficient to provide the temporary sealing of each respective chamber. Tether line 28 is affixed to belt loop 52 and is adapted to receive band 26.

Figure 4B:
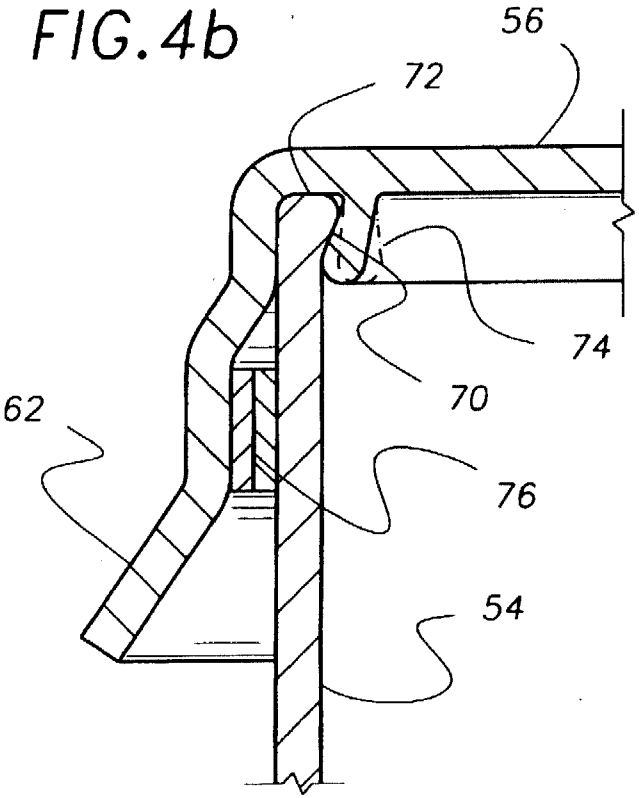
FIG. 4*b* depicts a sectional view of the upper portion of the flotation device housing, taken along lines 4*b*—4*b* of FIG. 4*a*.
Figure 4:
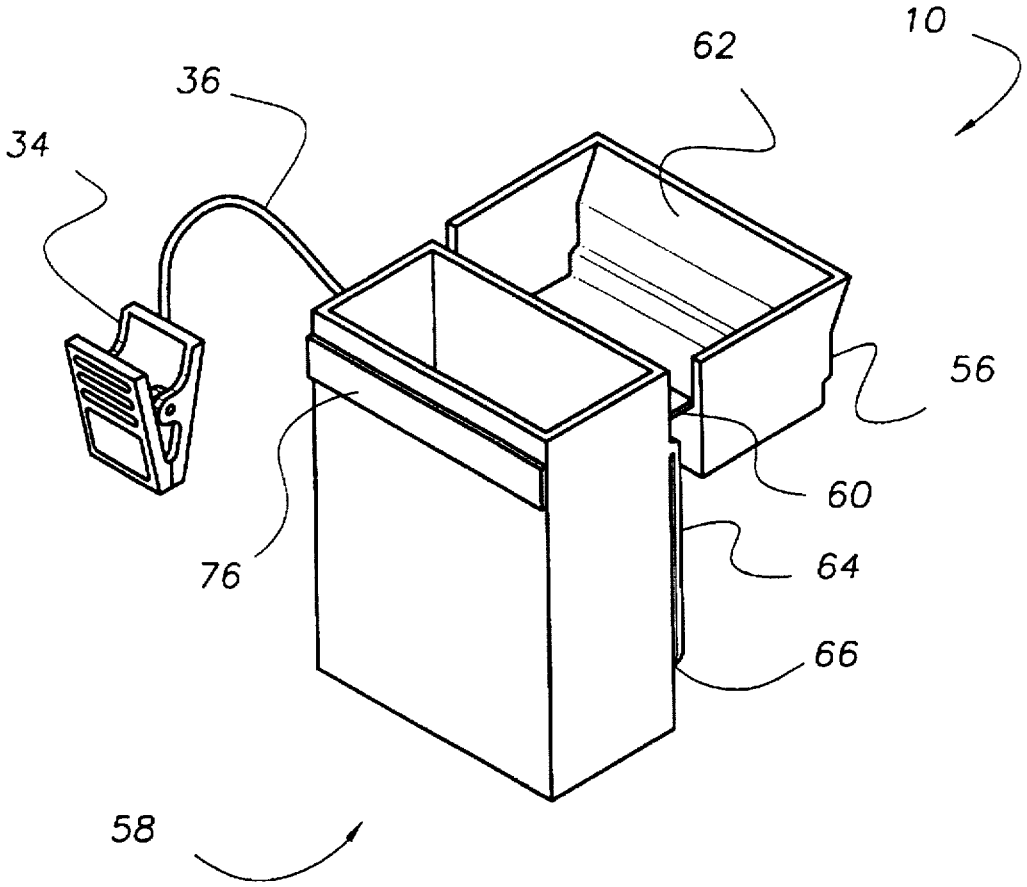
FIG. 4 shows an alternate embodiment of the case that houses the flotation device, in its opened position.

Referring now to FIG. 4, there is shown an alternate embodiment of the flotation device case 12 (FIG. 1), shown generally at reference numeral 58. A lid 56 is connected to the case 58 by means of a plastic or living hinge 60. Lid 56 has a front tab 62 provided so that the user can easily open the case 58, when necessary.

Figure 4A:
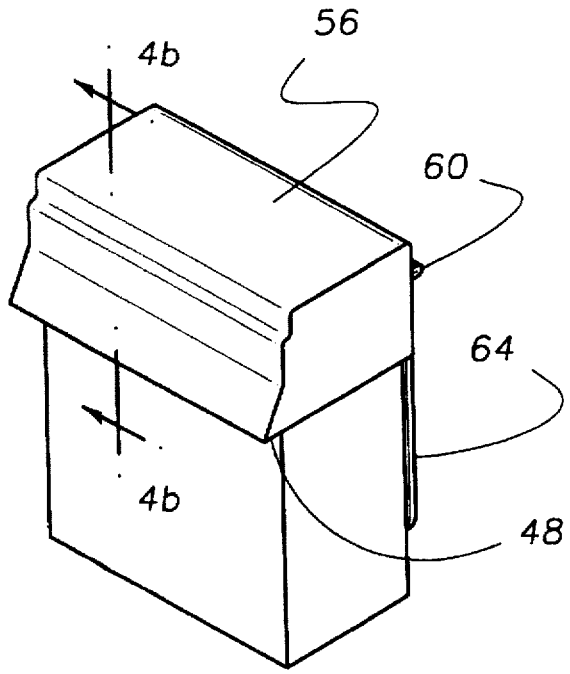
FIG. 4*a* shows the case of FIG. 4 in its closed position.

FIG. 4*a* is a perspective view of the case 58 in which lid 56 is shown in a closed position. A belt loop 64 with a snap 66 at the bottom, is connected to the back of case 58. Cord 36 is affixed to the belt loop 64 providing an external fastening point for a security fastener 34. A tether line, not shown, is affixed to the inside of the case 58 and the collar, not shown. In operation, the collar must be removed from the case 58 before inflating. The unit's flotation capability and waterproof design are important for anyone in, on or near water (e.g., boaters, fishermen, swimmers).

Referring now also to FIG. 4*b*, the housing or case 58 contains all of the components of the flotation device, when deflated. Lid 56 closes over the top edges of the case 58. The soft, pliable lid 56 has a sealing lip 70 on the four sides that close on the case edge boss 72. When the lid 56 is being closed, the case edge boss 72 forces the flex sealing lip 70 open to the position 74, shown in phantom. The spring characteristic of the plastic forces the lip 70 against the case edge boss 72. A soft plastic material may be also used for sealing. This seals the lid 56 to the case 58. Front tab 62 is used for quick opening and closing of the lid 56. A hook and loop fastening 76 holds the lid 56 and case 58 tightly closed.

The soft, pliable embodiment is free of any protrusion that may hinder the user's freedom of movement.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pocket-sized, portable flotation device, comprising:

a carrying case which can be easily worn or carried about many different areas of one's person due to its small size;

a flotation collar folded within said carrying case in a deflated position, said flotation collar expanding into a diamond shape for the purpose of fitting snugly about a user's neck in order to keep the user's head afloat, said flotation collar comprising a plurality of inflatable chambers, with each chamber receiving inflatable gas from its adjacent chamber via means defining an internal orifice disposed between respective adjacent chambers, said orifices being substantially pinched off to prevent or reduce passage of gas out of each respective chamber when said collar inflates into said diamond shape, whereby accidental deflation of all of the chambers is prevented, in the event that one of said plurality of chambers loses gas;

a gas cartridge disposed inside said carrying case, and having inflatable communication with said plurality of inflatable chambers of said flotation collar; and actuation means connected to said gas cartridge and supported by said carrying case, for actuating said gas cartridge to expel its gas and inflate said flotation collar to form said diamond shape.

2. The pocket-sized, portable flotation device in accordance with claim 1, wherein said carrying case comprises separable sides which are forced open when said gas cartridge expels its gas to inflate said flotation collar.

3. The pocket-sized, portable flotation device in accordance with claim 2, wherein said carrying case comprises a security fastener for attaching said flotation device to a user.

4. The pocket-sized, portable flotation device in accordance with claim 2, wherein said carrying case comprises an attachable band that is connected to said flotation collar for attaching said flotation collar to a user.

5. The pocket-sized, portable flotation device in accordance with claim 2, wherein said carrying case comprises a loop for attaching said carrying case to a belt worn by said user.

6. The pocket-sized, portable flotation device in accordance with claim 2, wherein said actuation means comprises a lanyard that can be pulled to actuate said gas cartridge.

7. A pocket-sized, portable flotation device that can be worn or supported about various parts of a user's body due to its extremely small size, comprising:

a carrying case which can be easily worn or carried about many different areas of one's person, said carrying case having a lid pivotally attached thereto for ease of opening;

a flotation collar folded within said carrying case in a deflated position, said flotation collar expanding into a diamond shape for the purpose of fitting snugly about a user's neck in order to keep the user's head afloat, said flotation collar comprising a plurality of inflatable chambers, with each chamber receiving inflatable gas from its adjacent chamber via means defining an internal orifice disposed within sectional walls arrayed between respective adjacent chambers, said orifices being substantially pinched off to prevent or reduce passage of gas between respective sectional walls and out of each respective chamber when said collar inflates into said diamond shape, whereby accidental deflation of all of the chambers is prevented, in the event that one of said plurality of chambers loses gas;

a gas cartridge disposed inside said carrying case, and having inflatable communication with said plurality of inflatable chambers of said flotation collar; and actuation means connected to said gas cartridge and supported by said carrying case, for actuating said gas cartridge to expel its gas and inflate said flotation collar to form said diamond shape.

8. The pocket-sized, portable flotation device in accordance with claim 7, wherein said lid further comprises sealing means for preventing water seepage into said carrying case.

9. The pocket-sized, portable flotation device in accordance with claim 8, wherein said carrying case comprises a security fastener for attaching said flotation device to a user.

10. The pocket-sized, portable flotation device in accordance with claim 8, wherein said carrying case comprises an attachable band that is connected to said flotation collar for attaching said flotation collar to a user.

11. The pocket-sized, portable flotation device in accordance with claim 8, wherein said carrying case comprises a loop for attaching said carrying case to a belt worn by said user.

12. The pocket-sized, portable flotation device in accordance with claim 8, wherein said actuation means comprises a lanyard that can be pulled to actuate said gas cartridge.

13. The pocket-sized, portable flotation device in accordance with claim 8, further comprising a blow tube that is attached to one of said plurality of chambers, for providing means for inflating said flotation collar or for completing the inflation thereof.

14. The pocket-sized, portable flotation device in accordance with claim 8, wherein said flotation collar comprises at least one gas release valve for facilitating evacuation of gas from said flotation collar.

15. The pocket-sized, portable flotation device in accordance with claim 8, wherein said gas comprises $CO_2$ stored under pressure.

* * * * *